US010900332B2

(12) United States Patent
Al-Anazi

(10) Patent No.: US 10,900,332 B2
(45) Date of Patent: Jan. 26, 2021

(54) EXTENDABLE PERFORATION IN CASED HOLE COMPLETION

(71) Applicant: Saudi Arabian Oil Company, Dhahran (SA)

(72) Inventor: Hamoud Ali Al-Anazi, Al-Khubar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 123 days.

(21) Appl. No.: 15/697,308

(22) Filed: Sep. 6, 2017

(65) Prior Publication Data

US 2019/0071955 A1 Mar. 7, 2019

(51) Int. Cl.

| | |
|---|---|
| ***E21B 43/112*** | (2006.01) |
| ***E21B 43/119*** | (2006.01) |
| ***E21B 43/10*** | (2006.01) |
| ***E21B 43/08*** | (2006.01) |
| ***E21B 17/10*** | (2006.01) |

(52) U.S. Cl.

CPC ..... *E21B 43/112* (2013.01); *E21B 17/1014* (2013.01); *E21B 43/08* (2013.01); *E21B 43/10* (2013.01); *E21B 43/119* (2013.01)

(58) Field of Classification Search

CPC ..... E21B 43/26; E21B 43/11; E21B 43/112; E21B 33/14

See application file for complete search history.

(56) References Cited

U.S. PATENT DOCUMENTS

| | | | |
|---|---|---|---|
| 5,224,556 A | 7/1993 | Wilson et al. | |
| 5,390,745 A | 2/1995 | Harden et al. | |
| 6,009,947 A * | 1/2000 | Wilson | E21B 43/11 166/100 |
| 6,688,395 B2 | 2/2004 | Maguire et al. | |
| 6,755,249 B2 | 6/2004 | Robison et al. | |
| 7,036,600 B2 | 5/2006 | Johnson et al. | |

(Continued)

FOREIGN PATENT DOCUMENTS

| | | |
|---|---|---|
| GB | 1483183 | 8/1977 |
| GB | 2407111 A | 4/2005 |

OTHER PUBLICATIONS

International Search Report and Written Opinion for related PCT application PCT/US2018/049456 dated Dec. 21, 2018.

*Primary Examiner* — Kipp C Wallace
(74) *Attorney, Agent, or Firm* — Bracewell LLP; Constance G. Rhebergen; Linda L. Morgan

(57) ABSTRACT

System and methods for providing a fluid flow path through a lower casing and a cement of a subterranean well includes a plurality of perforation tubes extending through a sidewall of a lower casing, the perforation tubes moveable from a retracted position to an extended position. In the retracted position a minor length of the perforation tubes is located outside of an outer diameter surface of the lower casing. In the extended position, a major length of the perforation tubes is located outside of the outer diameter surface of the lower casing, the major length being greater than the minor length. In the extended position, the perforation tubes extend radially outward from the outer diameter surface of the lower casing. Each of the plurality of perforation tubes is positioned axially along the lower casing to be moveable to an extended position in a formation zone of the subterranean well.

20 Claims, 3 Drawing Sheets

(56) References Cited

U.S. PATENT DOCUMENTS

| | | | | |
|---|---|---|---|---|
| 7,316,274 | B2 | 1/2008 | Xu et al. | |
| 7,401,648 | B2 * | 7/2008 | Richard | E21B 43/082 166/278 |
| 7,422,069 | B2 | 9/2008 | Richard et al. | |
| 7,591,312 | B2 | 9/2009 | Johnson et al. | |
| 7,938,188 | B2 | 5/2011 | Richard et al. | |
| 8,104,538 | B2 * | 1/2012 | Richard | E21B 33/1208 166/177.5 |
| 8,365,827 | B2 | 2/2013 | O'Connell et al. | |
| 9,033,044 | B2 | 5/2015 | Huang | |
| 9,074,453 | B2 * | 7/2015 | Richard | E21B 33/10 |
| 2008/0035349 | A1 * | 2/2008 | Richard | E21B 43/08 166/308.1 |
| 2008/0296024 | A1 | 12/2008 | Huang et al. | |
| 2009/0173497 | A1 * | 7/2009 | Dusterhoft | E21B 43/025 166/276 |
| 2010/0230103 | A1 | 9/2010 | Parker | |
| 2011/0162846 | A1 | 7/2011 | Palidwar | |

* cited by examiner

EXTENDABLE PERFORATION IN CASED HOLE COMPLETION

BACKGROUND

1. Field of the Disclosure

The present disclosure relates in general to the completion of subterranean wells, and more particularly to the formation of perforations within cased subterranean wells.

2. Description of the Related Art

In subterranean wells associated with hydrocarbon development operations, perforations provide a fluid flow path for fluids to travel between a subterranean formation and the inner bore of the well, or tubular members within the well. Perforations can be formed by perforation guns that can puncture the casing and a cement sheath in order to permit fluids surrounding the casing to flow into or out of the wellbore.

However, in some open-hole situations, suitable communication can not be achieved with perforation guns due to the irregularity of the open-hole that requires a thicker cement sheath around the casing. In addition, long reservoir sections can require multiple perforation runs since perforation guns can be generally only 30-40 feet long. Long wellbore section that are more than 40 feet in length requires several runs with live perforation guns and result in a significantly longer time to completing the perforation job, which results in associated increases in costs and in safety risks since live guns will be on location waiting for deployment.

Some other current methods for creating perforations utilize an expandable liner or casing, however, expandable liners and casing will still require a perforation job by either a wireline or coiled tubing unit. Currently, expandable liners and casing can be run in a first trip during completion stage with a drilling rig. Upon completing the drilling operation, the operator will then attend the well to perform the perforation across the liner or casing to establish communication with the reservoir in a second trip.

SUMMARY OF THE DISCLOSURE

Embodiments of this disclosure provide methods and systems for providing a fluid flow path through a lower casing and a cement of a subterranean well that includes extendable perforation tubes mounted on the casing or liner that will be run and set at a specified depth across the pay zone. A tool can push the perforation tubes radially outward to reach the formation. Then the tool will be pulled out of the hole and the casing or liner can be cemented. Once the well is completed, the perforation tubes will be opened by either using fluid pressure or acid to remove a plug within the perforation tubes. Embodiments of this disclosure can combine in one trip both the extendable and perforation features.

In an embodiment of this disclosure, a system for providing a fluid flow path through a lower casing and a cement of a subterranean well includes a plurality of perforation tubes extending through a sidewall of a lower casing, the perforation tubes moveable from a retracted position to an extended position. In the retracted position a minor length of the perforation tubes is located outside of an outer diameter surface of the lower casing. In the extended position, a major length of the perforation tubes is located outside of the outer diameter surface of the lower casing, the major length being greater than the minor length. In the extended position, the perforation tubes extend radially outward from the outer diameter surface of the lower casing. Each of the plurality of perforation tubes is positioned axially along the lower casing to be moveable to an extended position in a formation zone of the subterranean well.

In alternate embodiments, an outer surface of the perforation tubes can be free of grooves that limit the radial extension of the perforation tubes. The major length of the perforation tubes can be adjustable between the minor length and any position up to a maximum length. The perforation tubes can be freely moveable to any length between the minor length and the maximum length. In the retracted position the perforation tubes can include a removable internal plug. The lower casing can extend within the subterranean well and can be surrounded by liner cement and the perforation tubes can extend through the liner cement. The lower casing can be a liner.

In an alternate embodiment of this disclosure, a system for providing a fluid flow path through a lower casing and a cement of a subterranean well includes a lower casing extending into a cased wellbore of a subterranean well. A plurality of perforation tubes extend through a sidewall of the lower casing, the perforation tubes moveable from a retracted position to an extended position. In the retracted position a minor length of the perforation tubes is located outside of an outer diameter surface of the lower casing and the remaining length of the perforation tubes is located within the lower casing. In the extended position, a major length of the perforation tubes is located outside of the outer diameter surface of the lower casing, the major length being greater than the minor length. In the extended position, the perforation tubes extend radially outward from the outer diameter surface of the lower casing through a liner cement and towards an inner diameter surface of a formation zone of the subterranean well.

In alternate embodiments, an outer surface of the perforation tubes can be free of grooves that limit the radial extension of the perforation tubes so that the major length of the perforation tubes is adjustable between the minor length and any position up to a maximum length. The perforation tubes can be freely moveable to any length between the minor length and the maximum length. In the retracted position the perforation tubes can include a removable internal plug. The perforation tubes can be movable from the retracted position to the extended position with a tool that is run through the lower casing. The lower casing can be a liner In yet another embodiment of this disclosure, a method for providing a fluid flow path through a lower casing and a cement of a subterranean well includes extending a plurality of perforation tubes through a sidewall of a lower casing, the perforation tubes moveable from a retracted position to an extended position. In the retracted position a minor length of the perforation tubes is located outside of an outer diameter surface of the lower casing. In the extended position, a major length of the perforation tubes is located outside of the outer diameter surface of the lower casing, the major length being greater than the minor length. In the extended position, the perforation tubes extend radially outward from the outer diameter surface of the lower casing. Each of the plurality of perforation tubes is positioned axially along the lower casing to be moveable to an extended position in a formation zone of the subterranean well.

In other alternate embodiments, an outer surface of the perforation tubes can be free of grooves that limit the radial extension of the perforation tubes. The major length of the perforation tubes can be adjustable between the minor length and any position up to a maximum length. The perforation tubes can be freely moveable to any length between the minor length and the maximum length. In the retracted position the perforation tubes can include a removable internal plug and the method can further include removing the removable internal plug after the perforation tubes are moved to the extended position. The lower casing can be extended within the subterranean well with the perforation tubes in the retracted position. The lower casing can be surrounded with cement after moving the perforation tubes to the extended position. The perforation tubes can be moved from the retracted position to the extended position with a tool that is run through the lower casing. The lower casing can be a liner

BRIEF DESCRIPTION OF THE DRAWINGS

So that the manner in which the above-recited features, aspects and advantages of the disclosure, as well as others that will become apparent, are attained and can be understood in detail, a more particular description of the embodiments of the disclosure briefly summarized above may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The Specification, which includes the Summary of Disclosure, Brief Description of the Drawings and the Detailed Description, and the appended Claims refer to particular features (including process or method steps) of the disclosure. Those of skill in the art understand that the disclosure includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the meaning commonly understood by one of ordinary skill in the art to which this disclosure relates unless defined otherwise.

As used in the Specification and appended Claims, the singular forms "a", "an", and "the" include plural references unless the context clearly indicates otherwise. As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Spatial terms describe the relative position of an object or a group of objects relative to another object or group of objects. The spatial relationships apply along vertical and horizontal axes. Orientation and relational words including "uphole" and "downhole"; "above" and "below" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the Specification and appended Claims to a method comprising two or more defined steps, the defined steps can be carried out in any order or simultaneously except where the context excludes that possibility.

Figure 1:
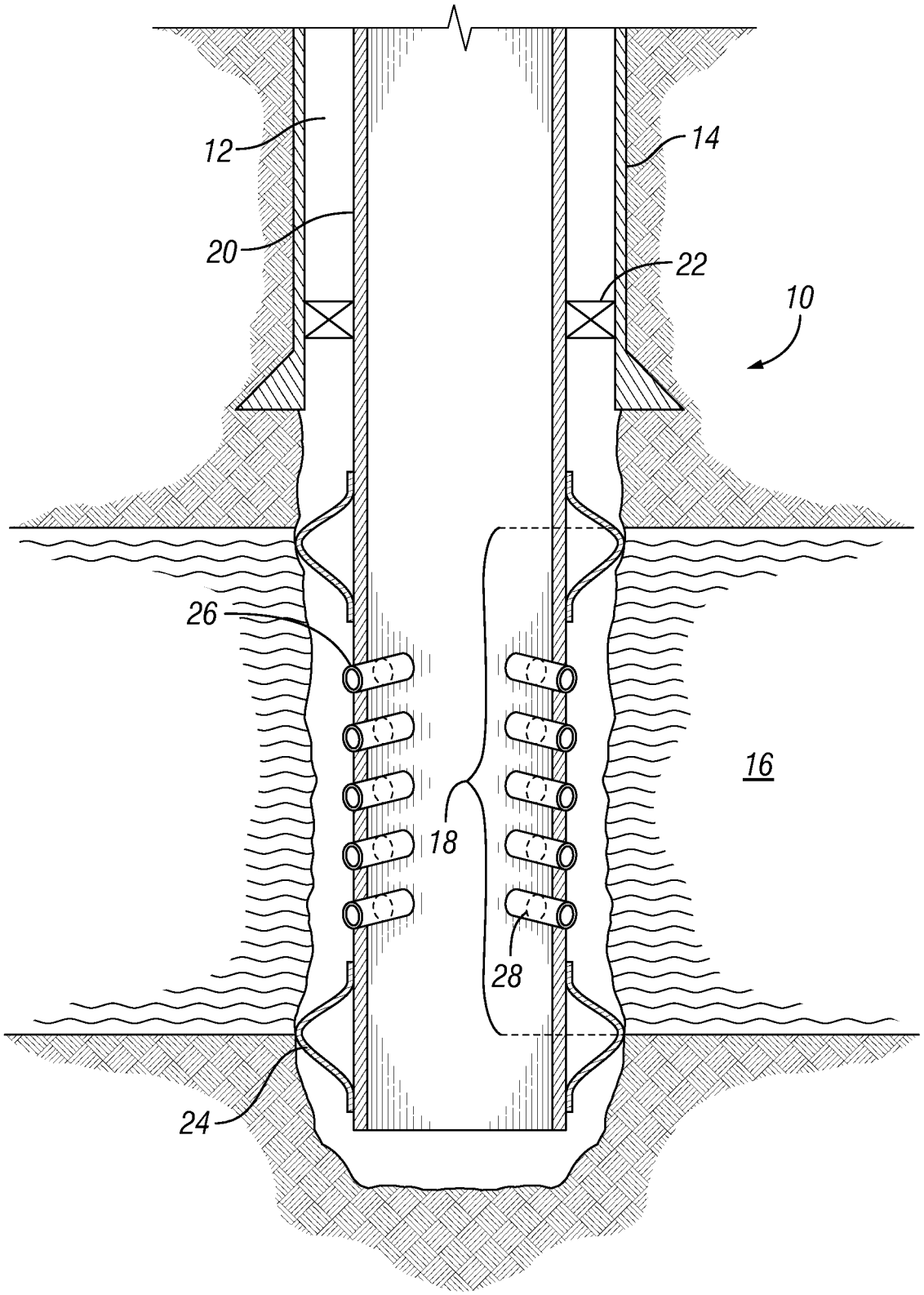
FIG. 1 is a schematic elevation view of a cased subterranean well with a system for providing a fluid flow path through a casing or liner and a cement of the subterranean well, in accordance with an embodiment of this disclosure, shown with perforation tubes in a retracted position.

Looking at FIG. 1 subterranean well 10 can be a well associated with hydrocarbon development, such as a production well or an injection well. Subterranean well 10 includes cased wellbore 12. Cased wellbore 12 is lined with casing 14 that extends into the bore of subterranean well 10 in a traditional manner. Casing 14 has a bottom end located at or above an elevation of subterranean formation 16. Subterranean formation 16 can be, for example, a hydrocarbon bearing formation or can be a formation intended for injection. Subterranean formation 16 meets subterranean well 10 at formation zone 18.

Below casing 14 within subterranean well 10 is an open hole region at formation zone 18. Lower casing such as well liner 20 can be lowered into the open hole region. Well liner 20 can be suspended from liner hanger 22 in a known manner. Well liner 20 can extend into or completely through formation zone 18. In order to center well liner 20 within the bore of subterranean well 10, traditional centralizers 24 are used. As is known, a well liner is a type of well casing that does not extend the entire length of the wellbore. In alternate embodiments, the lower casing can be another type of casing that can be used in subterranean well 10, such as an outer casing or an intermediate casing.

Well liner 20 houses a plurality of perforation tubes 26. Perforation tubes 26 extend through a sidewall of well liner 20. Perforation tubes 26 can be spaced around a circumference of well liner 20 over a predetermined length of well liner 20. Perforation tube 26 can be hollow member.

Each perforation tube 26 includes a removable internal plug 28. Removable internal plug 28 forms a solid barrier within perforation tube 26. Removable internal plug 28 can be, for example, a plug formed of dissolvable material such as calcium carbonate that can be dissolvable by an acid such as HCl, acetic acid, or formic acid. Alternately, removable internal plug 8 can be a rupture disc that is ruptured by pressure, such as by a hydraulic fluid pressure.

Figure 2:
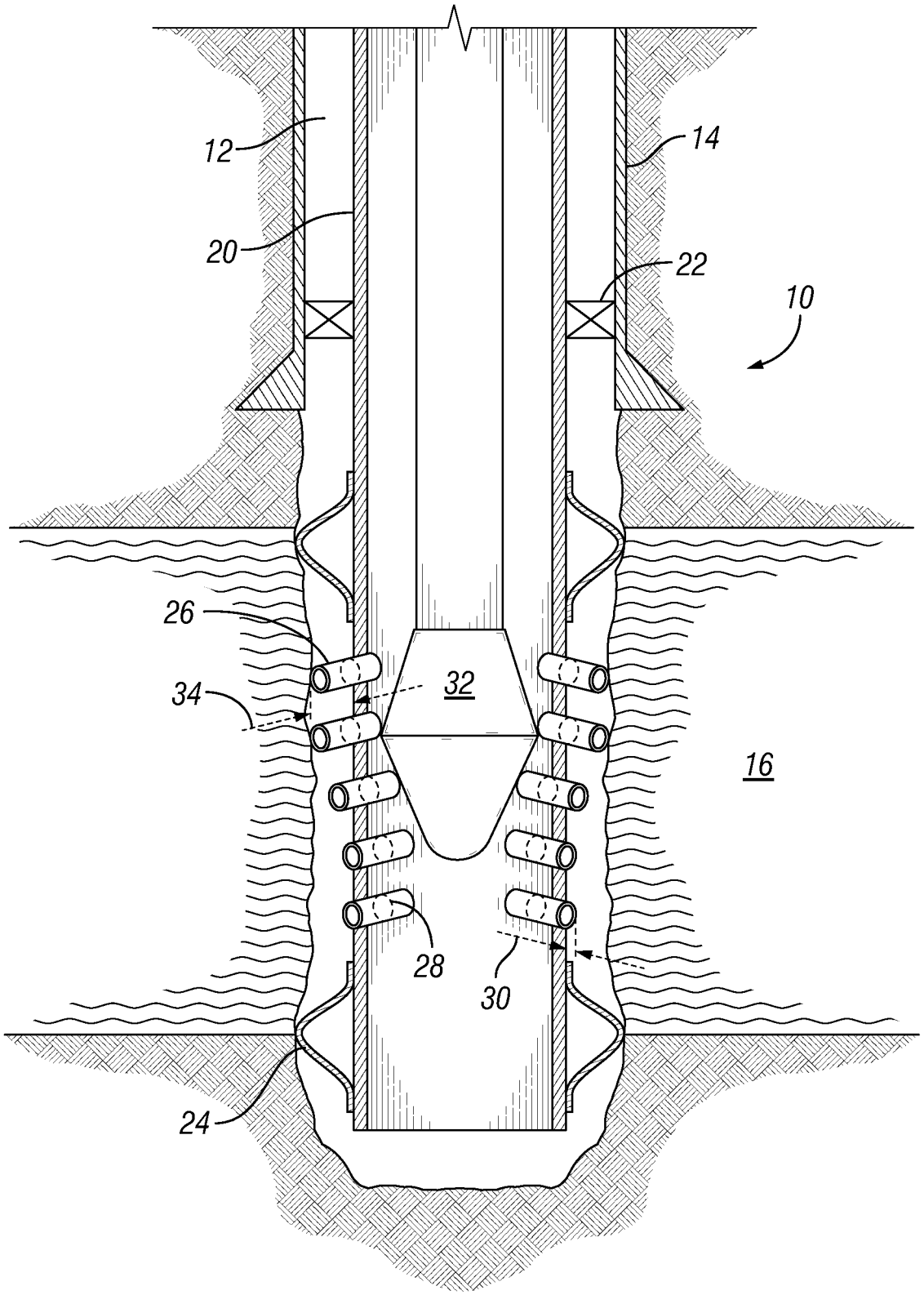
FIG. 2 is a schematic elevation view of a cased subterranean well with the system for providing a fluid flow path through a casing or liner and a cement of the subterranean well of FIG. 1, shown with perforation tubes being moved from the retracted position to an extended position using a tool.

Looking at FIG. 2, perforation tubes 26 are moveable from a retracted position to an extended position. In the retracted position a minor length 30 of perforation tube 26 is located outside of an outer diameter surface of well liner 20. The remaining length of perforation tube 26 is located within well liner 20. In the retracted position, the minor length 30 of perforation tube 26 that extends outside of well liner 20 will minimize the interference between the perforation tube 26 and the inner wall of casing 14 and the open borehole as well liner 20 is being lowered into subterranean well 10.

Tool 32 can be used to move perforation tubes 26 from the retracted position to the extended position. In the example embodiment of FIG. 2, tool 32 is run into well liner 20 and as tool 32 moves downward, an outer diameter of tool 32 engages the inner end of each of the perforation tubes 26, moving perforation tubes 26 radially outward. Tool 32 can be a simple tool with a conical, frustoconical, or other shaped outer surface for applying a radial force on perforation tube 26. Embodiments described herein are free of sliding sleeves, shifting tools and other more complicated arrangements that would be more costly and subject to increased risk of failure.

Perforation tubes 26 can extend radially outward from the outer diameter surface of well liner 20 towards an inner diameter surface of formation zone 18 of subterranean well 10. The outer end of certain or all of the perforation tubes 26 can reach and contact the inner diameter surface of formation zone 18 of subterranean well 10. In order to achieve maximum expansion of perforation tubes 26 so that perforation tubes 26 reach the inner diameter surface of formation zone 18, the bore diameter of subterranean well 10 can be precisely assessed before running the completion.

In the extended position perforation tubes 26 extend radially outward from the outer diameter surface of well liner 20. In the extended position, a major length 34 of perforation tube 26 is located outside of the outer diameter surface of well liner 20. Major length 34 is greater than minor length 30. Major length 34 of perforation tube 26 is adjustable between minor length 30 and any position up to a maximum length. The maximum length is the length at which the greatest possible length of perforation tube 26 is located outside of well liner 20.

An outer surface of perforation tube 26 is free of any grooves or other features that would limit or otherwise set the radial extension of perforation tube 26. Therefore perforation tube 26 is freely moveable to any length between minor length 30 and the maximum length. As such, perforation tubes 26 cannot act to centralize well liner 20 and traditional centralizers 24 are instead needed to centralize well liner 20 within the wellbore.

The predetermined length of well liner 20 along which perforation tubes 26 are positioned aligns with formation zone 18 so that each of the plurality of perforation tubes 26 is positioned axially along well liner 20 to be moveable to an extended position within formation zone 18 of subterranean well 10. None of the perforation tubes 26 extend radially towards regions of subterranean well 10 outside of formation zone 18.

Figure 3:
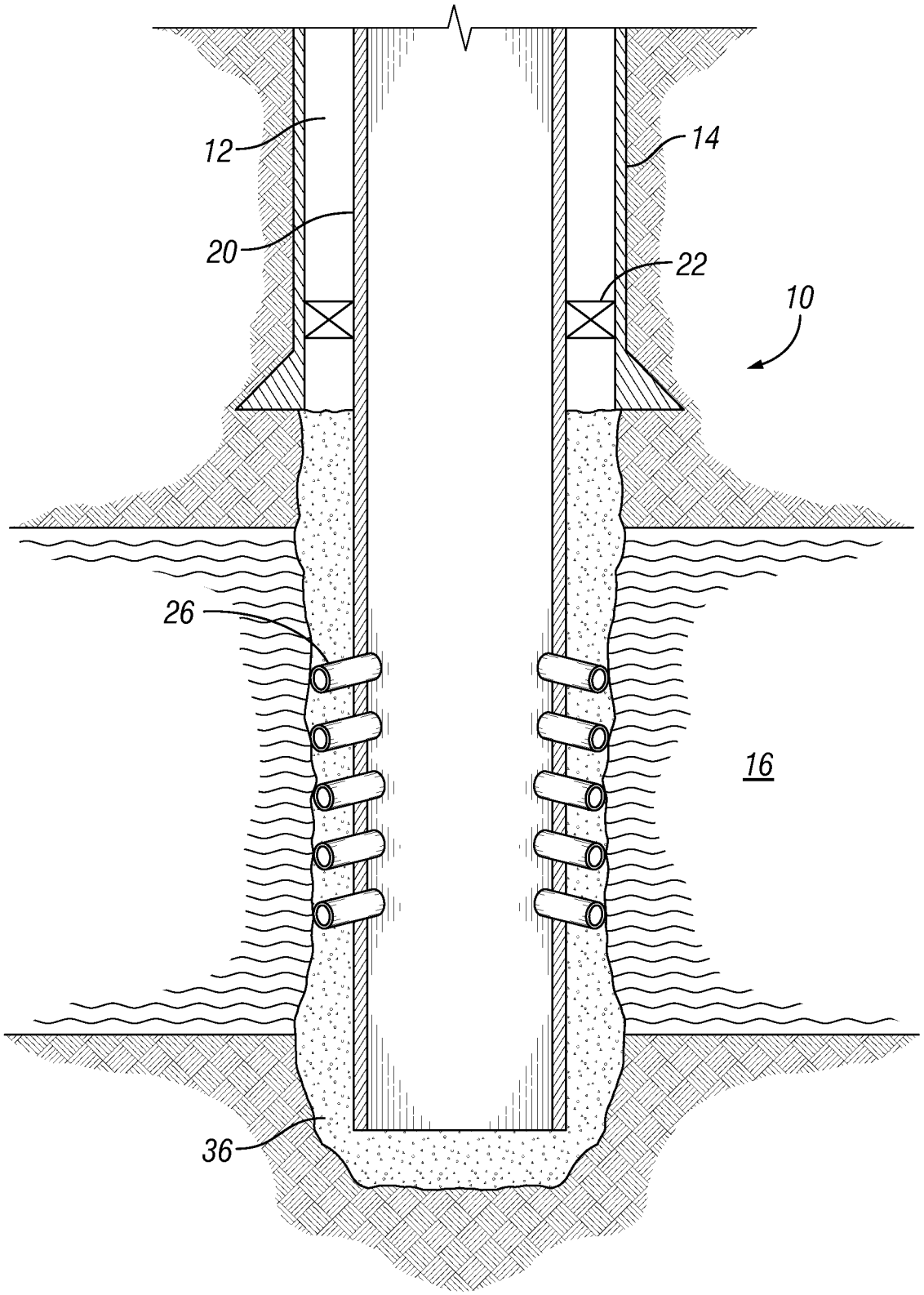
FIG. 3 is a schematic elevation view of a cased subterranean well with the system for providing a fluid flow path through a casing or liner and a cement of the subterranean well of FIG. 1, shown with perforation tubes in the extended position and with a cement sheath.

Looking at FIG. 3, well liner 20 can be cemented through known cementing techniques so that well liner 20 is surrounded by liner cement 36. Before well liner 20 is cemented, perforation tubes 26 moved to the extended position. After well liner 20 is cemented, perforation tubes 26 extend through liner cement 36. With the removal of removable internal plug 28, perforation tube 26 provides a fluid flow path through well liner 20 and liner cement 36 of subterranean well 10 so that there is fluid communication between subterranean formation 16 and an inner bore of well liner 20.

In an example of operation, looking at FIG. 1, after drilling the section of subterranean well 10 across subterranean formation 16, the casing or liner, such as well liner 20, that is equipped with perforation tubes 26 is run into the wellbore of subterranean well 10 and placed or landed in a conventional mater. Perforation tubes 26 are in a retracted position. The casing or liner is set at the required depth so that all of the perforation tubes 26 are located within formation zone 18.

Looking at FIG. 2, tool 32 can then be run through the casing or liner in a known manner. Tool 32 pushes perforation tubes 26 radially outward, moving perforation tubes 26 to an extended position. Looking at FIG. 3, after perforation tubes 26 are in the extended position, tool 32 can be pulled out of subterranean well 10 and the casing or liner can be cemented in a traditional manner. Removable internal plug 28 within each perforation tube 26 can be removed by fluid pressure or using a certain type of acid.

In this way, perforation tubes 26 provide a fluid flow path between subterranean formation 16 and the casing or liner within subterranean well 10. The fluid flow path between subterranean formation 16 and the casing or liner within subterranean well 10 can be used, for example, for completion purposes including production, injection, acid stimulation, proppant fracturing, or combination thereof.

Embodiments of this disclosure therefore disclose systems and methods that can be applied in all types of well completions, including vertical, deviated, S-Shaped, horizontal, and multi-laterals. A good flow communication between the wellbore and the reservoir can be established while avoiding the use of multiple runs of perforation gun in thick reservoir pay zone, avoiding the need for any wellbore intervention with wirelines or coiled tubing units with perforation guns, and avoiding expensive perforation operation in horizontal wells. No external packers or screens are required and by replicating parts, multiple stages can simply be accommodated.

Embodiments described herein, therefore, are well adapted to carry out the objects and attain the ends and advantages mentioned, as well as others inherent therein. While certain embodiments have been described for purposes of disclosure, numerous changes exist in the details of procedures for accomplishing the desired results. These and other similar modifications will readily suggest themselves to those skilled in the art, and are intended to be encompassed within the scope of the present disclosure disclosed herein and the scope of the appended claims.

What is claimed is:

1. A system for providing a fluid flow path through a lower casing and a cement of a subterranean well, the system including:

a plurality of perforation tubes extending through a sidewall of the lower casing, the perforation tubes moveable from a retracted position to an extended position, where an overall length of each of the plurality of perforation tubes in the retracted position is equal to the overall length of each of the plurality of perforation tubes in the extended position; wherein in the retracted position a minor length of the perforation tubes is located outside of an outer diameter surface of the lower casing;

in the extended position, a major length of the perforation tubes is located outside of the outer diameter surface of the lower casing, the major length being greater than the minor length;

in the extended position, the perforation tubes extend radially outward from the outer diameter surface of the lower casing;

each of the plurality of perforation tubes is positioned axially along the lower casing to be moveable to the extended position in a formation zone of the subterranean well; and the plurality of perforation tubes are spaced axially between an uphole centralizer and a downhole centralizer, the uphole centralizer and the downhole centralizer operable to centralize the lower casing within the subterranean well; where the major length of the perforation tubes is adjustable between the minor length and any position up to a maximum length, the perforation tubes are movable from the retracted position to the extended position with a tool that is run axially through the lower casing, and where the tool is operable to engage the inner end of the perforation tubes and move the inner end of the perforation tubes radially outward to move the perforation tubes to the maximum length; and each of the perforation tubes are formed of a single tubular member with a constant outer diameter along an entire length of the perforation tube, and with an inner end spaced radially outward of a central axis of the lower casing in both the retracted position and the extended position.

2. The system of claim 1, wherein an outer surface of the perforation tubes is free of grooves that limit a radial retraction of the perforation tubes.

3. The system of claim 1, wherein the major length of the perforation tubes is adjustable between the minor length and any position up to a maximum length.

4. The system of claim 3, wherein the perforation tubes are freely moveable to any length between the minor length and the maximum length.

5. The system of claim 1, wherein in the retracted position the perforation tubes include a removable internal plug.

6. The system of claim 1, wherein the perforation tubes extend within the subterranean well and are surrounded by liner cement.

7. The system of claim 6, wherein the perforation tubes extend through the liner cement.

8. The system of claim 1, wherein the lower casing is a liner.

9. A system for providing a fluid flow path through a lower casing and a cement of a subterranean well, the system including:

the lower casing extending into a cased wellbore of the subterranean well;

a plurality of perforation tubes extending through a sidewall of the lower casing, the perforation tubes moveable from a retracted position to an extended position where an overall length of each of the plurality of perforation tubes in the retracted position is equal to the overall length of each of the plurality of perforation tubes in the extended position; wherein in the retracted position a minor length of the perforation tubes is located outside of an outer diameter surface of the lower casing and a remaining length of the perforation tubes is located within the lower casing;

in the extended position, a major length of the perforation tubes is located outside of the outer diameter surface of the lower casing, the major length being greater than the minor length;

in the extended position, the perforation tubes extend radially outward from the outer diameter surface of the lower casing through a liner cement and towards an inner diameter surface of a formation zone of the subterranean well; and the perforation tubes are spaced axially between an uphole centralizer and a downhole centralizer, the uphole centralizer and the downhole centralizer operable to centralize the lower casing within the subterranean well; where the major length of the perforation tubes is adjustable between the minor length and any position up to a maximum length;

the perforation tubes are movable from the retracted position to the extended position with a tool that is run axially through the lower casing, and where the tool is operable to engage the inner end of the perforation tubes and move the inner end of the perforation tubes radially outward to move the perforation tubes to the maximum length; and each of the perforation tubes are formed of a single tubular member with a constant outer diameter along an entire length of the perforation tube, and with an inner end spaced radially outward of a central axis of the lower casing in both the retracted position and the extended position.

10. The system of claim 9, wherein an outer surface of the perforation tubes is free of grooves that limit a radial retraction of the perforation tubes.

11. The system of claim 10, wherein the perforation tubes are freely moveable to any length between the minor length and the maximum length.

12. The system of claim 10, wherein in the retracted position the perforation tubes include a removable internal plug.

13. The system of claim 9, wherein the lower casing is a liner.

14. A method for providing a fluid flow path through a lower casing and a cement of a subterranean well, the method including:

extending a plurality of perforation tubes through a sidewall of the lower casing, the perforation tubes moveable from a retracted position to an extended position where an overall length of each of the plurality of perforation tubes in the retracted position is equal to the overall length of each of the plurality of perforation tubes in the extended position; wherein in the retracted position a minor length of the perforation tubes is located outside of an outer diameter surface of the lower casing;

in the extended position, a major length of the perforation tubes is located outside of the outer diameter surface of the lower casing, the major length being greater than the minor length, the major length of the perforation tubes being adjustable between the minor length and any position up to a maximum length;

in the extended position, the perforation tubes extend radially outward from the outer diameter surface of the lower casing;

each of the plurality of perforation tubes is positioned axially along the lower casing to be moveable to the extended position in a formation zone of the subterranean well;

the plurality of perforation tubes are spaced axially between an uphole centralizer and a downhole centralizer, the uphole centralizer and the downhole centralizer operable to centralize the lower casing within the subterranean well; and each of the perforation tubes are formed of a single tubular member with a constant outer diameter along an entire length of the perforation tube, and with an inner end spaced radially outward of a central axis of the lower casing in both the retracted position and the extended position; and extending a plurality of perforation tubes through a sidewall of the lower casing includes moving the perforation tubes from the retracted position to the extended position with a tool that is run axially through the lower casing, where the tool is operable to engage the inner end of the perforation tubes and move the inner end of the perforation tubes radially outward to move the perforation tubes to the maximum length.

15. The method of claim 14, wherein an outer surface of the perforation tubes is free of grooves that limit a radial retraction of the perforation tubes.

16. The method of claim 14, wherein the perforation tubes are freely moveable to any length between the minor length and the maximum length.

17. The method of claim 14, wherein in the retracted position the perforation tubes include a removable internal plug the method further includes removing the removable internal plug after the perforation tubes are moved to the extended position.

18. The method of claim 14, further including extending the lower casing within the subterranean well with the perforation tubes in the retracted position.

19. The method of claim 18, further including surrounding the lower casing with the cement after moving the perforation tubes to the extended position.

20. The method of claim 14, wherein the lower casing is a liner.

* * * * *